United States Patent [19]

Gold

[11] Patent Number: 5,067,175

[45] Date of Patent: Nov. 26, 1991

[54] PADDED GARMENT

[76] Inventor: Danny Gold, 23 Repulse Bay Rd., Apt. 4B, Hong Kong, Hong Kong

[21] Appl. No.: 576,614

[22] Filed: Aug. 31, 1990

[51] Int. Cl.[5] ..... A41D 13/00

[52] U.S. Cl. ..... 2/16; 2/2; 2/161 R

[58] Field of Search ..... 2/2, 16, 22, 23, 24, 2/20, 159, 160, 161 A, 161 R, 163, 267, 19, 166, 243 R, 275, 169, 18

[56] References Cited

U.S. PATENT DOCUMENTS

| | | | |
|---|---|---|---|
| 3,125,762 | 3/1964 | Glahe | 2/2 |
| 4,411,024 | 10/1983 | Hayes | 2/20 |
| 4,484,359 | 11/1984 | Tirinen | 2/20 |
| 4,675,914 | 6/1987 | Mitchell | 2/166 |
| 4,688,269 | 8/1987 | Maeshima | 2/2 |
| 4,700,407 | 10/1987 | Mattila | 2/2 |
| 4,756,026 | 7/1988 | Pierce, Jr. | 2/22 |
| 4,768,234 | 9/1988 | Yamamoto | 2/161 A |
| 4,815,147 | 3/1989 | Gazzano et al. | 2/2 |
| 4,884,295 | 12/1989 | Cox | 2/2 |
| 4,930,162 | 6/1990 | Cotè2 | 16/ |

*Primary Examiner*—Werner H. Schroeder
*Assistant Examiner*—Amy Brooke Vanatta
*Attorney, Agent, or Firm*—Peter D. Aufrichtig

[57] ABSTRACT

A padded garment covering at least a portion of a body part including gloves, mittens, boots, pants, sweaters and other wearing apparel. A garment panel for forming an outer surface of the garment includes at least first and second panel members. Each of the first and second panel members includes a panel section and a seam tolerance section. Each panel section and seam tolerance section is separated by a seam location. Padding protects at least a portion of a body part. A chamber member is coupled to the first and second panel members at their respective seam locations to create a chamber for containing the padding positioned proximate to the outer surface of the garment. A coupling, such as sewn seam or heat sealed seam is used to join the chamber member and the seam locations of the first and second panel members. The chamber member is joined to the garment panel between the seam locations of the first and second panel members.

20 Claims, 5 Drawing Sheets

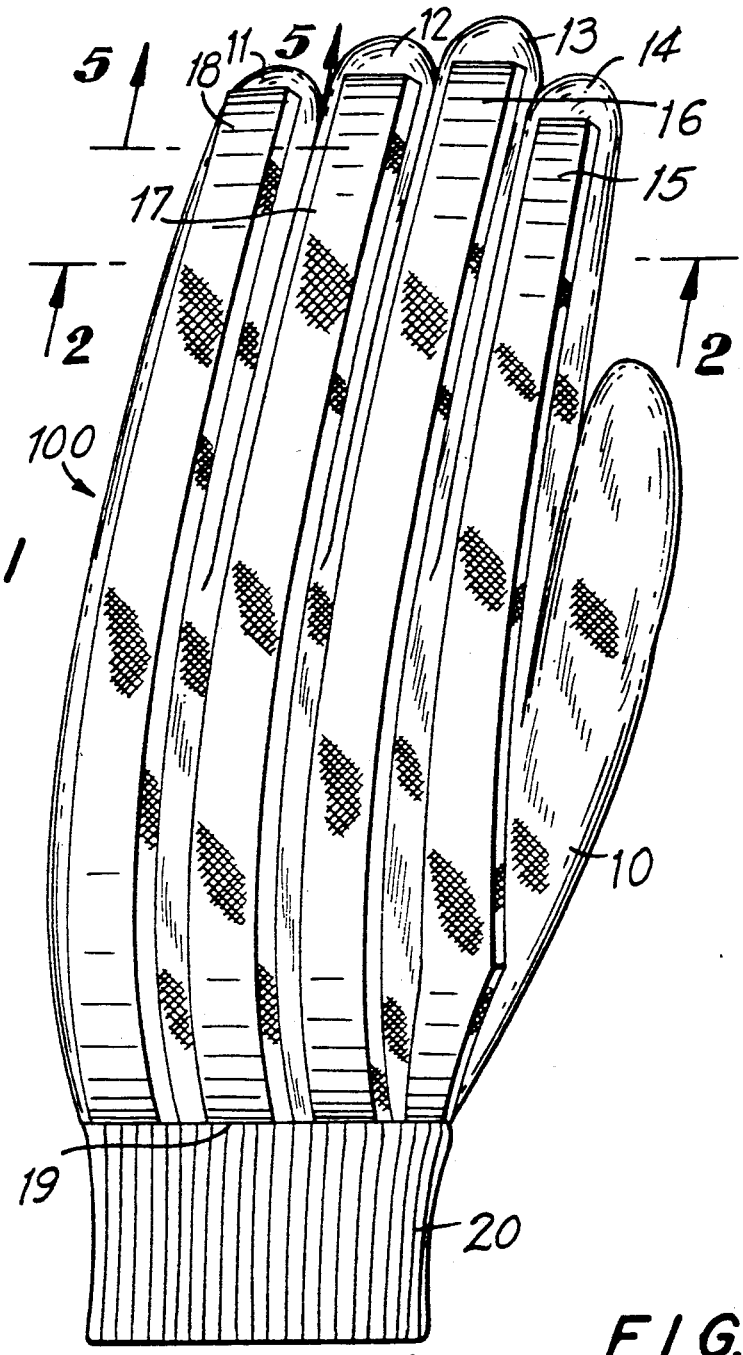
FIG. 1
FIG. 2
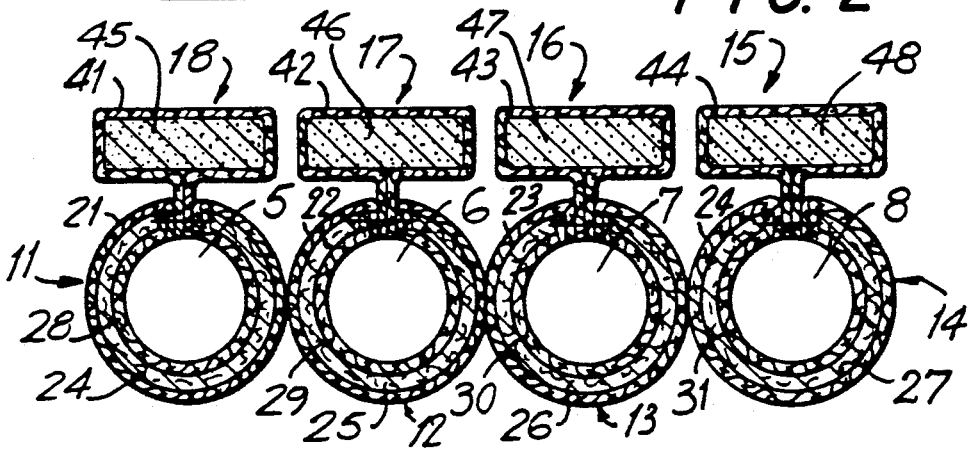

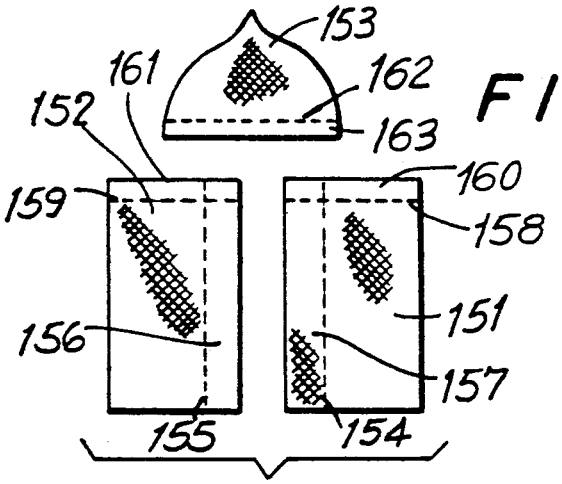
FIG. 7
FIG. 8
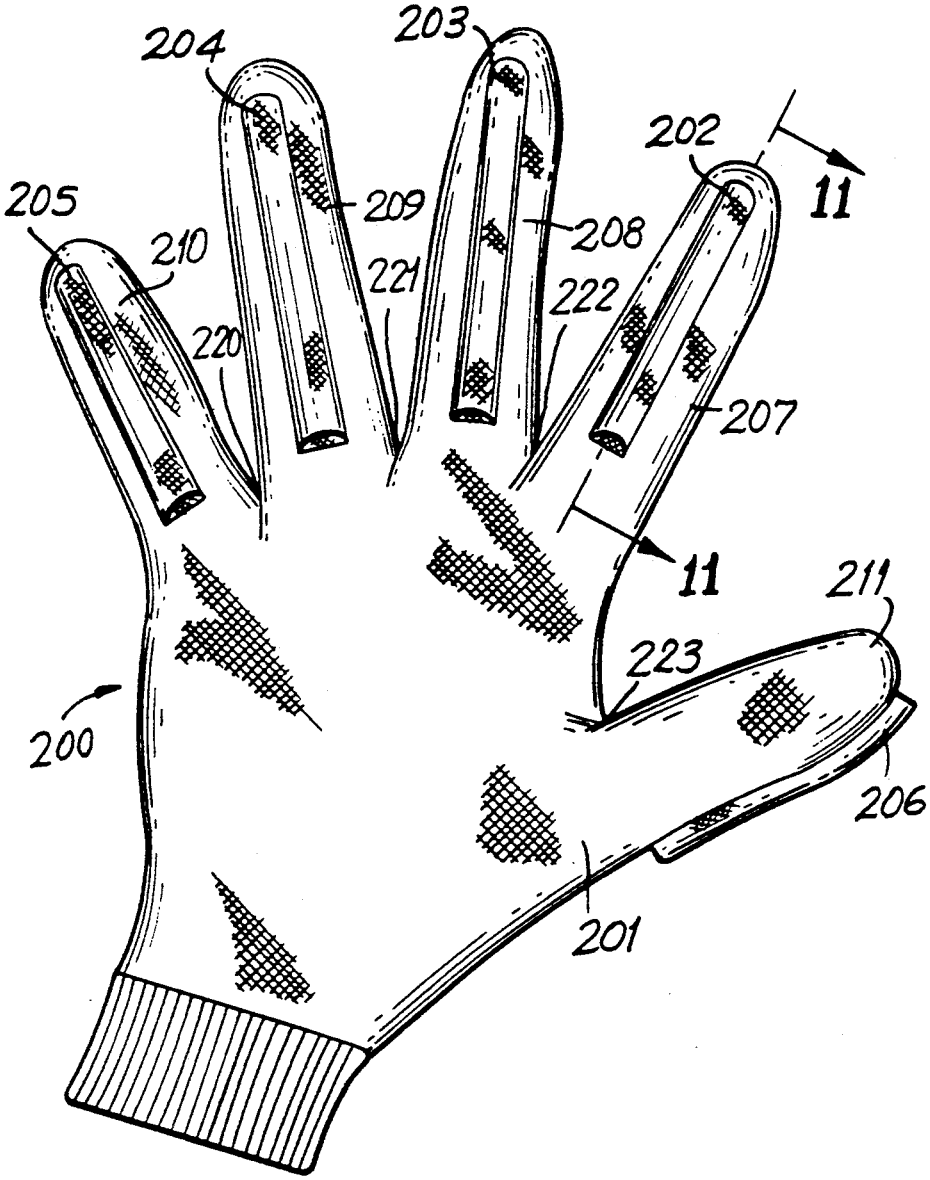

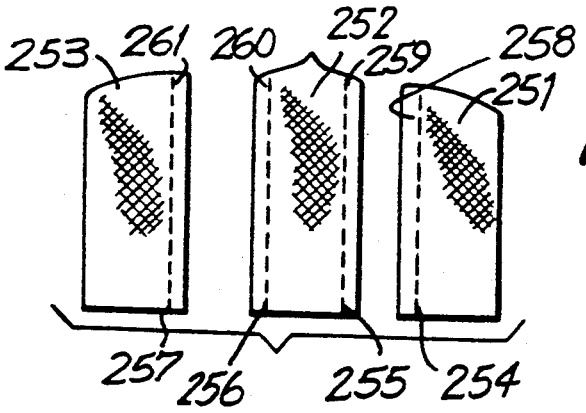
FIG. 9
FIG. 10
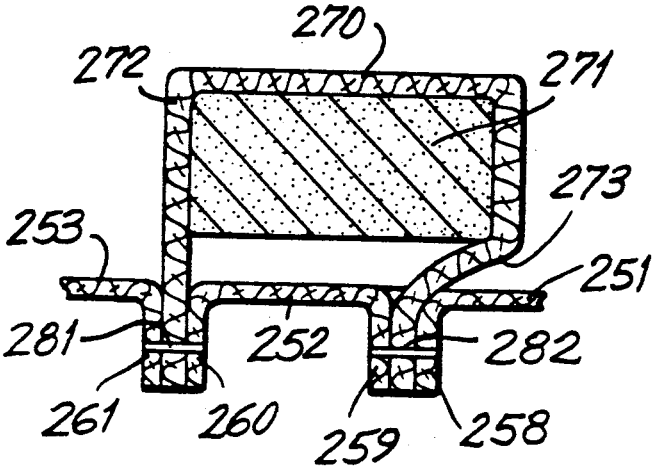
FIG. 11
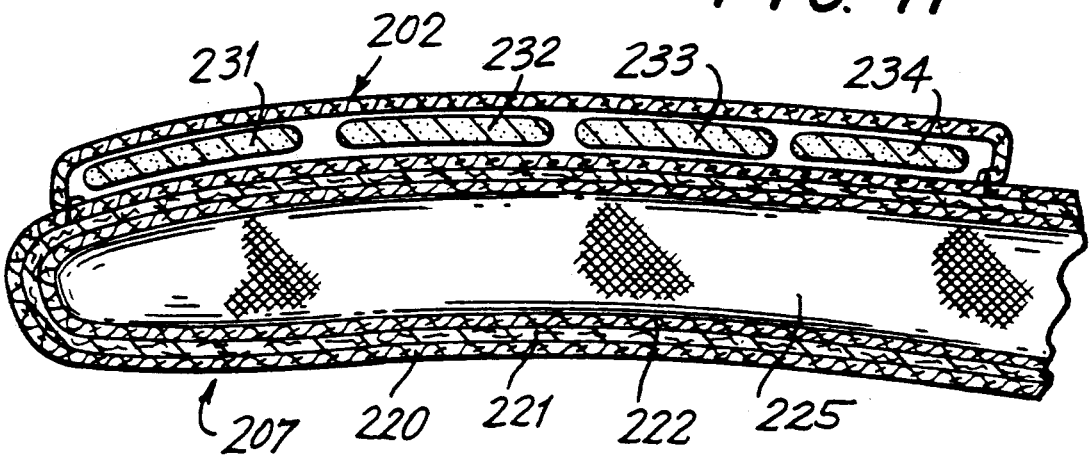

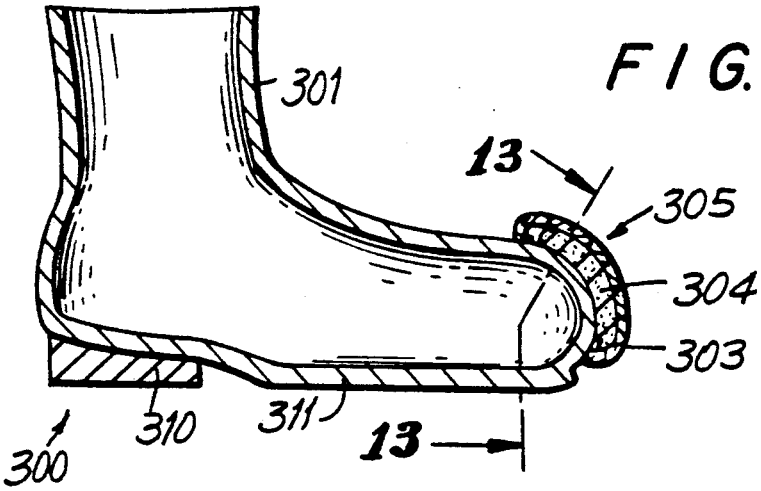
FIG. 12
FIG. 13
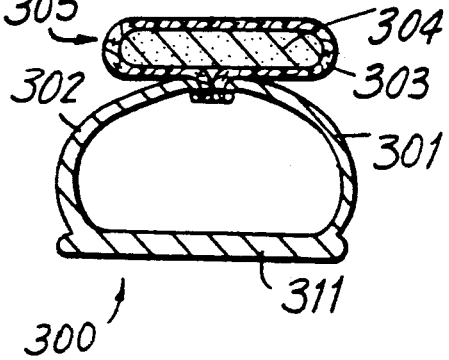
FIG. 14
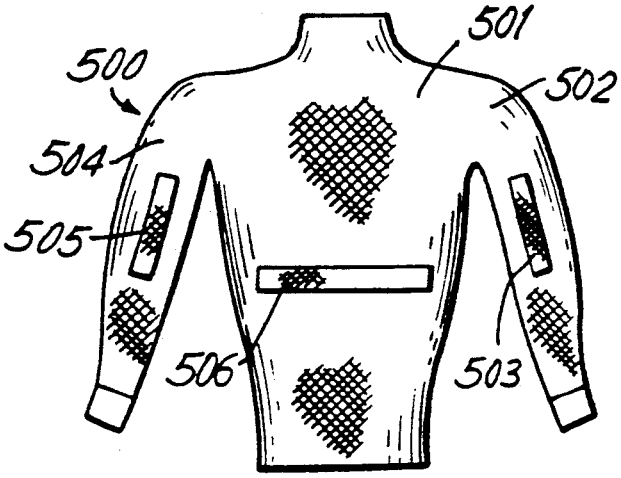
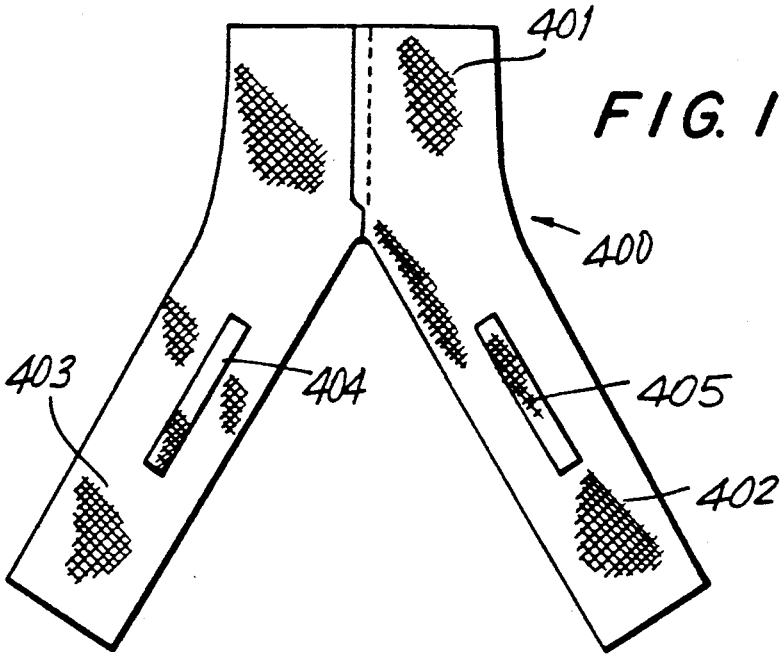
FIG. 15

PADDED GARMENT

BACKGROUND OF THE INVENTION

The invention is directed to a padded garment and in particular to a chamber padded glove, boot or other article of clothing.

Gloves have been padded in various different ways to protect the hand of the wearer during different types of activities. Ski gloves, work gloves, bicycle gloves and hockey gloves have been padded to protect the wearer's hands against injury due to violent contact which is expected in these intended uses.

In the past, glove makers have tried various different approaches to pad the outer portion of the glove, i.e., the portion covering the top of the wearer's hands and fingers. Unfortunately, when padding had been added to the outside of the glove, the padding restricts the flexibility of the glove. The padding, which has been added both to the inside and outside surfaces of the top of the glove stiffens the glove and provides a substantial barrier to necessary flexibility of the fingers.

For example, it is important in ski gloves, particularly those designed for use by a ski racer, that there be enough padding on the outside of the glove to protect the skier's hands in a fall and when skiing slalom gates. When skiing slalom gates good technique requires the skier to attempt to hit each slalom gate as it is passed.

Several different types of padding have been added to gloves to protect the wearer's hand. One type of padding is a hard padding added to or molded on the exterior of the glove in large sections. This type of padding, while protecting the wearer's hand, severely restricts the flexibility of the glove. This sort of glove is not particularly useful in applications where flexibility of the fingers and hand are required. Unfortunately, most glove applications require some flexibility for comfort and utility.

A second type of padding is formed of smaller hard pads which are sewn, molded to or otherwise attached to the exterior of the glove. The pads are often molded plastic, metal or rubber. Generally, these armored gloves have padding over the portions of the glove which do not cover the wearer's joints. In this way, the flexibility of the glove is maintained by these articulated pads because the portion of the glove over the joints, which rotate and expand when the hand is curled inward toward a fist position, is unencumbered by padding.

This approach has two very severe drawbacks. The first is that the joints of the fingers and hand are relatively unprotected and the protection offered by the gloves is reduced. The second problem with this approach is the substantial cost associated with manufacture. To implement this sort of armored articulated glove, as disclosed in U.S. Pat. No. 4,768,234, requires the molding and cutting of about 25 separate pads, some of which are quite small. Then, each of the pads must be individually attached to the exterior of the glove. In addition, there must be separate sets of the protector pads for each of the different sizes of gloves. A particular finger pad for a men's large size glove would likely be inappropriate for another size glove, such a men's medium size glove or a ladies medium size glove. In addition, the assembly of a glove with so many specialized pieces would be difficult. Thus, the costs associated with development, manufacture and assembly of such a glove are particularly high and the benefits limited.

Similarly, the protective work glove disclosed in U.S. Pat. No. 4,766,612 includes stiff protective members which seriously restrict the flexibility of the glove in use. In addition, the protective members must be separately configured for each size of glove as well as sizing the protective members for each of the different fingers.

The batting glove disclosed in U.S. Pat. No. 3,942,975 includes a pair of protective plates attached to the back surface of the batting glove. The large pads do not cover the finger tips and due to their size will tend to restrict the flexibility of the hand in motion.

U.S. Pat. No. 4,675,914 is directed to a hard-grip glove which utilizes a coiling mechanism for aiding gripping and providing some padding. This approach suffers from many of the same disabilities described above including poor protection of the wearer's fingers and difficulty of manufacture and assembly.

Other approaches which have been developed include the placement of a free floating pad in a closed chamber on top of the hand portion of the glove to contain the padding. However, this approach, which utilizes a chamber covering the entire back surface of the glove which is secured around the top edge of the glove, restricts flexibility due to the glove's resistance to the change in hand geometry caused by the curling of the wearer's hand and requires sewing additional layers of material in the finger crotch regions. Specifically, the length and circumference of the finger portions and hand portions of the glove must increase as the wearer's fingers are curled inward toward a fist position to accommodate these changes in the hand and finger geometry. Gloves which have pads attached to the outside of the glove around areas of the surface tend to restrain the glove from increasing its geometry to adapt to the increased size of the hand in this condition.

Another problem with padding gloves, particularly on the fingers, is the difficulty of sewing the crotch region if padding is added to the crotch. The crotch region of the glove is the V-shaped area where the bases of the fingers of the glove are attached. If padding is added to the glove around the crotch this makes assembly significantly more difficult and affects the geometry of the glove, changing the fit of the glove and the manner in which it responds to hand movements.

Similar problems exist in connection with the padding of boots, shoes, pants, such as ski pants, ski jackets and other padded garments.

Accordingly, there is a need for an improved padded glove for protecting the fingers, knuckles and other parts of the glove without making the glove too rigid or difficult to manufacture or assemble. Particularly, there is a need for padding which is uniform for various sizes of gloves so that separate molds or pads do not have to be created for each of the fingers for each of the different sizes of gloves. Also there is a need for a glove which may be padded without affecting the fit or restricting the changes in geometry of the glove during use.

SUMMARY OF THE INVENTION

The invention is directed to a padded garment for covering at least a portion of a body part. A garment panel forms an outer surface of the garment. The garment panel includes at least first and second panel members. Each of the first and second panel members includes a panel section and a seam tolerance section.

Each panel section meets the corresponding seam tolerance section at a seam location A padding member protects at least a portion of the body part. A chamber member is coupled to the first and second panel members at their respective seam locations for creating a chamber for containing the padding in a position proximate to the outer surface of the garment. A coupling, such as a sewn or heat sealed seam, is used to join the chamber member and the seam locations of the first and second panel members. The chamber member is joined to the garment panel between the seam locations of the first and second panel members.

Accordingly, it is an object of the invention to provide an improved padded garment.

Another object of the invention is to provide an improved padded glove which pads the fingers and hand portions of the glove without unnecessarily increasing the bulkiness or restricting flexibility.

A further object of the invention is to provide an improved padded garment with chambers for holding the padding attached to a bisected upper garment portion including sufficient seam tolerance for addition of the chamber and enclosed padding to the garment portion without affecting the normal pattern or geometry of the glove.

Yet another object of the invention is to provide an improved chamber padded glove in which different types of padding can be utilized to selectively protect different portions of the wearer's hands.

Still a further object of the invention is to provide an improved padded glove wherein standard size padding can be uniformly utilized for different sizes of gloves.

Yet a further object of the invention is to provide an improved padded glove wherein the padding protects the hands about the crotch regions between the fingers without the need for sewing any padding or other layers of material into the crotch region of the glove.

A further object of the invention is to provide an improved padded garment including boots, shoes, hands, elbow guards, ski jacket and other wearing apparel which effectively pads the wearer's body part at or about a joint without substantially restricting the flexibility of the garment as the joint is rotated.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a glove constructed in accordance with a preferred embodiment of the invention;

FIG. 2 is a cross-sectional view taken along line 2—2 of FIG. 1;

FIG. 7 is a top plan view of an unassembled glove finger top panel in accordance with another preferred embodiment of the invention;

FIG. 8 is a perspective view of glove constructed in accordance with another preferred embodiment of the invention; FIG. 9 is a top plan view of an unassembled glove finger top panel in accordance with another preferred embodiment of the invention;

FIG. 10 is an enlarged cross-sectional view similar to FIG. 5 of a chamber formed with the glove finger top panel of FIG. 9 assembled in accordance with a preferred embodiment of the invention;

FIG. 11 is a cross-sectional view taken along line of 11—11 of FIG. 8;

FIG. 12 is a cross-sectional view taken along the midline of a boot constructed in accordance with the invention;

FIG. 13 is a cross-sectional view taken along line 13—13 of FIG. 12;

FIG. 14 is a top plan view of a padded pair of pants constructed in accordance with the invention; and FIG. 15 is a top plan view of a padded sweater constructed in accordance with the invention.

DETAILED DESCRIPTION OF THE PREFERRED EMBODIMENTS

Figure 4:
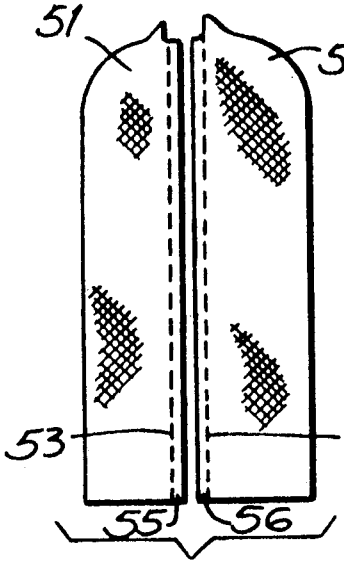
FIG. 4 is a top plan view of an unassembled glove finger top panel constructed in accordance with a preferred embodiment of the invention.

Reference is made to FIGS. 1 and 2 wherein a glove 100 constructed in accordance with a preferred embodiment of the invention is depicted. Like elements are represented by like reference numerals. Glove 100 also includes thumb 10 and fingers 11, 12, 13 and 14. Glove 100 includes a wrist seam 19 and wrist covering portion 20. In addition, glove 100 includes padded chambers 15, 16, 17 and 18 on fingers 14, 13, 12 and 11, respectively. Padded chambers 15, 16, 17 and 18 extend from proximate the tips of fingers 14, 13, 12 and 11, along the fingers, across the back of the hand portion, and down to wrist seam 19.

Figure 3:
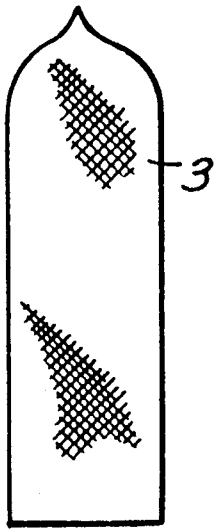
FIG. 3 is a top plan view of a glove finger top panel in accordance with the prior art.

Reference is next made to FIGS. 3 and 4 wherein the assembly of the glove finger top panel is depicted. FIG. 3 shows a glove finger top panel 3 constructed in accordance with the prior art. The glove finger top panel 3 and a glove finger bottom panel(not shown) form the outer shell of a glove at a finger and are attached to the inner portions of the glove which generally include an inner shell liner and an insulating layer. Panel 3 is the top outer shell member and would be attached to the lower outer shell member around an insulating layer 14 (FIG. 2) and an inner shell layer 28. Generally, in accordance with the prior art, a molded or other conventional pad would be attached to top panel 3 either by stitching, molding, gluing or some other means of attachment. However, the attachment of padding to the outside of panel 3 has the effect of restricting the flexibility of panel 3.

In contrast, as seen in FIG. 4, instead of a single panel 3, as shown in FIG. 3, the glove constructed in accordance with the invention includes two panels 51, 52. Panels 51 and 52 are sized to include a seam tolerance in addition to the basic pattern. This allows panels 51, 52 to be assembled without affecting the overall geometry of the outer shell. Panels 51 and 52 in addition to the basic finger pattern include seam locations 53, 54 and seam tolerances 55, 56, respectively. Seam locations 53, 54 may be marked temporary with chalk, permanently, for example with ink or perforated to show where to join the panel. The padded chambers 15, 16, 17 and 18 are each inserted between the bisected outer shell panels 51, 52 and then sewn in place along seam locations 53, 54. In this way the geometry of the outer shell of the gloves does not differ in any way from the unpadded outer panel 3 shown in FIG. 3. Also, the padding itself is not sewn into the seam, and ease of assembly and flexibility are promoted.

As seen in FIG. 2, the finger portions 11, 12, 13 and 14 of glove 100 include outer shell layers 21, 22, 23 and 24, insulating layers 34, 25, 26 and 27 and inner shell layers 28, 29, 30 and 31 surrounding fingers 5, 6, 7 and 8, respectively. Padded chambers 18, 17, 16, 15 include padded chamber walls 41, 42, 43, 44 and padding 45, 46, 47 and 48.

Figure 5:
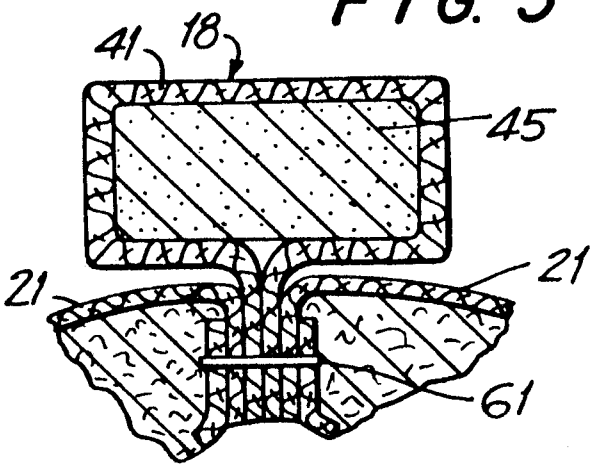
FIG. 5 is an enlarged cross-sectional view similar to FIG. 2 of only a portion of a padding chamber in accordance with a preferred embodiment of the invention.

The various elements can be seen most clearly in FIG. 5, where an enlarged view of the attachment of padded chamber 18 to outer shell layer 21 is depicted. The two free ends of outer shell 21 have a seam tolerance as shown in FIG. 4 which is utilized to secure the two free ends of padded chamber wall 41 in place, positioning chamber 18 on top of outer shell 21. Padding 45, which in a preferred embodiment is a continuous strip of foam padding, is contained within chamber wall 41. The free ends of chamber wall 41 and the seam locations of the free ends of outer shell wall 21 are sewn together with seam 61, as shown in FIG. 5.

Bisection of the pattern of the upper outer shell layer into two panels 51, 52, and addition of a seam tolerance to each panel, allows for the attachment of any size or shape padding chamber without affecting the geometry or fit of the glove fingers. In the embodiment of FIGS. 1 and 2, padded chambers 15, 16, 17 and 18 extend from proximate the finger tips to wrist seam 19. Depending upon the expected use of the glove, the padding can cover a lesser or greater portion of the glove. In the embodiment of FIGS. 7 described below the padding covers the fingers without covering the finger tip region or projecting beyond the finger crotch region. In the embodiment of FIG. 8 the padding extends from proximate the finger tips down to the finger crotches.

In a preferred embodiment, chamber 18, shown in FIG. 5, is at least partially sewn into outer shell layer 21 before padding 45 is tunneled, or pushed, into the chamber created by chamber wall 41. This method of manufacture is particularly useful where chamber 41 is formed of a stretchable material such as stretchable lycra or a flexible knit material. Then, after padding 45 is in place, the free ends of chamber wall 41 are stitched down at the finger tips and at wrist seam 19. Alternatively, chamber 18 may be attached in sections with separate pieces of foam, as shown in FIG. 11 and attached as each of the sections is sewn in place.

Where chamber wall 41 is formed of a more rigid material, such as a woven nylon or other material, which makes it difficult to tunnel the padding into the closed chamber, a different assembly approach may be utilized. Here, the ends of the chamber can be sewn to the glove finger bottom and wrist seam 19. Then, the padding is inserted within chamber wall 41 and the free ends of chamber wall 41 are sewn at the seam locations to both free ends of outer shell 21. The manner in which padded chambers 15, 16, 17 and 18 are attached to the outer shells 21, 22, 23 and 24 of glove 100 allows the height and width of the chambers to be independent of the width of the actual glove fingers. The chambers are only attached along a single line, with a single seam, and supports the padding above the glove without interfering with movement of the glove.

This attachment approach allows for uniformity in construction. All of the chambers can be the same size and utilize the same foam padding, both for different fingers on a single glove and for different fingers on different size gloves. Thus, a roll of material with constant width can be used for all of the chambers of all gloves in all different sizes. It is only necessary to cut the roll for each of the chamber walls to the appropriate length for each chamber. Likewise, the foam padding which comes in strips and rolls may be ordered in a single uniform width, usable for all fingers of all sizes of a glove. The padding is merely cut to the appropriate length for each chamber.

Of course, padded chambers of different widths may be utilized depending upon the application for the specific glove. In the embodiment shown in FIG. 2, padded chambers 15, 16, 17 and 18 are as wide as fingers 11, 12, 13 and 14 and form a complete protective layer across the tops of the fingers. On the other hand, in the embodiment of FIG. 8, padded chambers 202, 203, 204, 205 and 206 (covering the thumb) use narrow padding covering only a small portion of the fingers of the glove.

Figure 6:
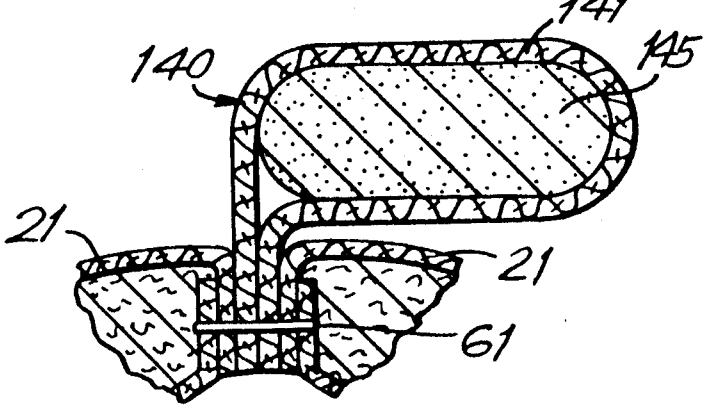
FIG. 6 is an enlarged cross-sectional view similar to FIG. 5 in accordance with a second preferred embodiment of the invention.

Likewise, as shown in FIG. 6, padded chamber 140 may extend to one side or the other so that chamber wall 141 surrounds padding 145 to the side of the connection point with the outer shell of the finger. This connection approach is particularly useful for gloves such as hockey gloves which are intended to provide substantial protection to the sides as well as the tops of the fingers. For such a glove the padding chambers for the middle fingers can be broadened so as to cover the tops of all four fingers with the padding chambers for the outside fingers being of the sort shown in FIG. 6 so that the padding extends sidewards beyond the edge of the hand and protects the hand from impact along the heel of the hand and between the index finger and thumb. Padded chamber 140 will retain its position relative to its connection point by being sewn in place at the ends of padding chamber 140.

Reference is next made to FIG. 7 wherein the outer shell for a glove constructed in accordance with another embodiment of the invention is depicted. The outer shell panels 151, 152, 153 are designed to receive a chamber wall 41 and padding 45 along the seam created between a point even with the finger crotch and the last knuckle on the finger. No padding is present beyond the last knuckle. A glove with this type of padding might be useful for applications which require flexibility and a small glove circumference at the tip, such as a trigger finger for a hunting glove.

Panels 151, 152 are joined with a chamber wall 41 at seam locations 154, 155 and include seam tolerances 156, 157 to allow such an attachment without affecting the basic pattern. In addition, panels 151, 152 include seam locations 158, 159 at the top, with seam tolerances 160, 161 for attachment to panel 153 along seam location 162 which includes seam tolerance 163.

By incorporating the seam tolerances 156, 157, 160, 161, 163 to panels 151, 152, 153, the basic prior art pattern shown in FIG. 3 is maintained while a suitable padded chamber is added to the glove construction. The construction, which generally, but not necessarily, utilizes a center seam of the top panel of each glove finger outer shell for attachment of chamber wall 41, avoids the addition of any material, such as padding, at or near the crotch regions of the glove, while allowing the finger crotches to be protected by padding. Any number of other arrangements of padding on various portions of the glove may be utilized in accordance with the invention.

Reference is next made to FIG. 8 wherein a glove, generally indicated as 200 constructed in accordance with another embodiment of the invention is depicted. Glove 200 includes a hand portion 201, fingers 207, 208, 209 and 210 and thumb 211. Each of the fingers and thumb include respective padded chambers 202, 203, 204, 205 and 206. The padded chambers 202, 203, 204, 205 and 206 are formed as narrow padded regions which cover only a portion of the width of the fingers and extend from proximate the finger tips to proximate finger crotches 220, 221, 222, 223. Padded chambers 202, 203, 204, 205 and 206 are attached to glove 200 in the same fashion as disclosed above with respect to the embodiment of FIGS. 1, 2 and 5.

Padded chambers 202, 203, 204, 205 and 206 may also be attached in a different fashion as shown in FIGS. 9 and 10.

As shown in FIG. 9, the upper panel of the outer shell of the glove is divided into three panels 251, 252, 253. Outer panels 251, 253 include single seam locations 254, 257 and seam tolerances 258, 261, respectively. Center panel portion 252 includes two seam locations 255, 256 and two seam tolerance areas 259, 260. As shown in FIG. 10, when assembled, one free end 272 of chamber wall 270 is sewn between seam positions 256, 257 with seam 281 and the other free end 273 of chamber wall 270 is sewn between seam locations 258, 259 with seam 282. Chamber padding 271, rather than being encircled by the chamber wall as in the embodiments of FIGS. 1, 2, 5 and 6, instead rests directly on the middle panel 252. In the embodiment of FIG. 10, the chamber walls may extend directly upward as shown proximate to free end 272 or may extend outward as shown proximate to right free end 273. The orientation of the side walls is depended on the expected use of the glove.

Reference is next made to FIG. 11 wherein an alternate embodiment of the invention with multiple padding members is depicted. Finger 207 includes outer shell layer 220, insulation layer 221 and inner shell layer 222 for enclosing finger 225. Padded chamber 202 includes four separate padding members 231, 232, 233 and 234. The separate padding members may be inserted to provide variable protection and may be varied in hardness and density to protect critical portions of the wearer's hand. The assembly approach which includes formation of the chamber prior to insertion of the padding is particularly appropriate for this embodiment in which the padding members can be consecutively inserted into the open end of the chamber until the chamber is filled.

Reference is next made to FIGS. 12 and 13 wherein a boot, generally indicated as 300, constructed in accordance with the invention is depicted. Boot 300 includes shoe top portions 301, 302, sole 311 and heel 310. Boot 300 also includes a padded chamber 305 formed by chamber wall 303 and padding 304. Padded chamber 305 is positioned to protect the wearer's toe and is attached in the same way as are padded chambers 15, 16, 17 and 18 in the embodiment of FIGS. 1 and 2. Shoe top portions 301, 302 have seam tolerances to maintain the pattern shape when they are sewn together. Chamber 320 may, however, be attached in different positions about boot 300 and in the various ways described in the other embodiments.

Reference is next made to FIG. 14 wherein a padded pair of pants, generally indicated as 400, constructed in accordance with the invention is depicted. Pair of pants 400 includes a waist portion 401 and leg portions 402, 403. Leg portions 402, 403 include padded chambers 404, 405 protecting the wearer's knee regions. Padded chambers 404, 405 can be coupled to leg portions 402, 403 in any of the ways disclosed above in the various embodiments. Specifically, padded chambers 404, 405 are attached in seams in leg portions 402, 403 with seam tolerances added to the pant leg portions to retain a normal pattern of the pants. Padded chambers may also be added in other locations on pants 400.

Reference is next made to FIG. 15 wherein a sweater, generally indicated as 500, constructed in accordance with the invention is depicted. Sweater 500 includes a body portion 501 and arm portions 502, 504. Arm portions 502, 504 include padded chambers 503, 505, respectively, which are positioned to cover the wearer's elbow. Sweater 500 also includes a padded chamber 506 attached to pad the wearer's solar plexus. Padded chambers 503, 505 and 506 can be attached in any of the ways described above.

The padded chamber arrangements described above can be utilized in connection with numerous other garments including but not limited to ski jackets, elbow guards, knee pads, socks and ballet slippers in which padding is considered desirable but flexibility is needed.

The chamber padding system utilized on gloves, mittens, boots and shoes, pants, sweaters and other garments and protective wear all can successfully incorporate the chamber padding system in accordance with the invention. The various different types of padding chambers and padding materials can all be utilized in accordance with the split outer shell system in which seam tolerances are added to the garment to allow incorporation of the padded chamber without affecting the outer garment geometry. The seam location in a preferred embodiment are marked on the garment, either temporarily with a chalk line or permanently with an ink or dye markings.

It will thus be seen that the objects set forth above, among those made apparent from the preceding description, may be made in the above constructions without departing from the spirit and scope of the invention, and it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A padded garment for covering at least a portion of a body part, comprising:

garment panel means for forming an outer surface of the garment, the garment panel means including at least first and second panel members, each of the first and second panel members including a panel section and a seam tolerance section separated by a seam location;

padding means for protecting at least a portion of the body part;

chamber means coupled to the first and second panel members at their respective seam locations for creating a chamber for containing the padding means in a position proximate the outer surface of the garment; and coupling means for joining the chamber means and the seam locations of the first and second panel members, the chamber means being joined to the garment panel means between the seam locations of the first and second panel members.

2. The padded garment of claim 1 wherein the garment is a glove and the garment panel means forms a top surface of a glove finger.

3. The padded garment of claim 1 wherein the garment is a glove including fingers and a wrist seam and the garment panels means forms a top surface of one of the fingers and a portion of a glove hand between a finger tip of one of the glove fingers and the wrist seam.

4. The padded garment of claim 2 wherein the chamber means includes a rectangular sheet of fabric having two long edges and two short edges.

5. The padded garment of claim 4 wherein the long edges of the rectangular fabric are inserted between the seam locations of the first and second panel members.

6. The padded garment of claim 1 wherein the padding means includes a foam pad.

7. The padded garment of claim 1 wherein the padding means includes a pad of constant cross-sectional area.

8. The padded garment of claim 1 wherein the padding means includes at least two separate pads contained in the chamber means.

9. The padded garment of claim 1 wherein the coupling includes a sewn thread holding the first and second panel members and chamber means together.

10. The padded garment of claim 1 wherein the garment panel means includes a third panel member having a panel section and seam tolerance section separated by a seam location and the second panel member further includes an additional seam tolerance section which is separated from the panel section by an additional seam location.

11. The padded garment of claim 10 wherein the chamber means is also coupled between the additional seam location of the second panel member and the seam location of the third panel member by the coupling means.

12. The padded garment of claim 1 wherein the panel sections of the first and second panel members together form a top half of an outer shell of a glove finger.

13. The padded garment of claim 1 wherein the panel sections of the first and second panel members together form a portion of an outer shell of a glove finger from proximate the last knuckle of the finger to proximate a base of the glove finger.

14. The padded garment of claim 1 wherein the panel sections of the first and second panel members together form a top outer surface of a finger of a glove and a portion of a back of a hand of the glove.

15. The padded garment of claim 1 wherein the garment panel means include four sets of first and second panel members and each pair of first and second panel sections forms a top outer surface of a finger of a glove.

16. The padded garment of claim 1 wherein the garment panel means include four sets of first and second panel members and each pair of first and second panel sections forms a top outer surface of a finger of a glove and a portion of a back of a hand portion of the glove.

17. The padded garment of claim 1 wherein the panel sections of the first and second panel members together form at least a portion of a top of a foot portion of a boot.

18. The padded garment of claim 1 wherein the panel sections of the first and second panel members together form at least a portion of a pant leg of a pair of pants.

19. The padded garment of claim 1 wherein the panel sections of the first and second panel members form at least a portion of a sweater.

20. A padded glove for covering at least a portion of a wearer's hand and fingers, comprising:

panel means for forming an outer surface of the glove, the panels means include at least first and second panel members, each of the first and second panel members including a panel section and a seam tolerance section separated by a seam location;

padding means for protecting at least a portion of the wearer' hand and fingers;

chamber means coupled to the first and second panel members at their respective seam locations for creating a chamber for containing the padding means in a position proximate the outer surface of the glove; and coupling means for joining the chamber means and the seam locations of the first and second panel members, the chamber means being joined to the panel means between the seam locations of the first and second panel members.

* * * * *